US006871378B2

(12) United States Patent
Larson et al.

(10) Patent No.: US 6,871,378 B2
(45) Date of Patent: Mar. 29, 2005

(54) AUTOMATED LAP WASHER

(76) Inventors: Robert Larson, 3131 Fite Cir., Sacramento, CA (US) 95827; Ron Ray, 3131 Fite Cir., Sacramento, CA (US) 95827

( * ) Notice: Subject to any disclaimer, the term of this patent is extended or adjusted under 35 U.S.C. 154(b) by 329 days.

(21) Appl. No.: 10/153,353

(22) Filed: May 24, 2002

(65) Prior Publication Data

US 2003/0217429 A1 Nov. 27, 2003

(51) Int. Cl.[7] ..... A47L 5/38
(52) U.S. Cl. ..... 15/302; 15/306.1; 15/308
(58) Field of Search ..... 15/302, 306.1, 15/308, 303

(56) References Cited

U.S. PATENT DOCUMENTS 3,530,526 A * 9/1970 Schmidt ..... 15/302
4,589,926 A * 5/1986 Holmstrand ..... 15/302
4,926,520 A * 5/1990 Watson ..... 15/302

* cited by examiner

*Primary Examiner*—Theresa T. Snider
(74) *Attorney, Agent, or Firm*—Frank A. Lukasik

(57) ABSTRACT

The invention is an automated lap washer and rack system for washing and drying aluminum laps used in the processing of opthalmic lenses and consists of an enclosure containing a washing and a drying chamber through which special mounting trays, removably attached to a table top conveyor, carry aluminum laps first through the washing stage and then through the drying chamber.

2 Claims, 7 Drawing Sheets

AUTOMATED LAP WASHER

BACKGROUND OF THE INVENTION

The present invention relates to the washing and drying of aluminum laps used in the processing of ophthalmic lenses and, more particularly, to an automated lap washer rack system structure having an enclosure containing a washing and a drying chamber through which special mounting trays, removably attached to a tabletop style conveyor, carry aluminum laps through first the washing and then the drying chambers.

Aluminum laps, used for the processing of ophthalmic lenses, are generally made of bar stock aluminum ranging in diameter from 2.5 to 3.5 inches. Laps weigh approximately one pound and have one to two convex curves on the topside and a flat grooved bottom. They have an indefinite life and are used continuously to hold special pads designed to smooth and polish ophthalmic lenses. The polishing process is accomplished in two steps, "fining" and "polishing". The fining process accomplished using a cylinder surface machine, uses a paper-like material typically coated with silicon carbide which removes material from the lens until it conforms to the convex shape of the lap. The polishing step replaces the fining pad with a soft woven velveteen backed pad which is impregnated with aluminum oxide polish to produce a clear transparent finish on the lens.

When polishing is complete, the lap is unclean and must be washed before the aluminum oxide dries and becomes difficult to remove. Washing laps by hand is laborious and time consuming and, in a large lens production facility, is counter-productive. The present invention facilitates the cleaning of large numbers of laps in an efficient and consistent manner as will be described in the following description and in the drawings annexed hereto.

SUMMARY OF THE INVENTION

In a preferred embodiment, the present invention provides an efficient, enclosed, and automatic means for conveying aluminum laps through a washing and drying cycle.

It is a further object of the invention to provide a conveyor means for carrying aluminum laps through the cleaning process.

It is a further object of the invention to provide trays for holding aluminum laps as they proceed through the cleaning cycle.

It is a further object of the invention to provide durable rotating brushes for cleaning the upper surface of aluminum laps and directed jets of water/air for cleaning the bottom of the laps.

It is a further object of the invention to provide a safety cut off switch.

It is a further object of the device to provide adjustable delivery means for both air and water.

It is a further object of the invention to provide filtration means for the efficient recycling of cleaning fluids used in the cleaning process.

The present invention is constructed in a unique assembly of components which are generally available commercially and to one skilled in the art the following parts list and the annexed drawings and description would serve to enable the successful construction of the invention.

Here follows the parts list to which, subsequent, more specific, and particular reference is made:

| Item & Quantity | Mfg | Model |
|---|---|---|
| Motor and Drive Assembly | | |
| 1 Motor Gearbox 2.3 amp, ¼ hp, 20:1 | Leeson | CM34025N21 2C |
| 1 Drive tightener | Browning | ATN1 |
| 1 Flat Faced Idlers | Browning | NIDO5F |
| 4 Bearings UHMW-PE | Dayton | 572 |
| 4 Shaft Collars (Delrin) | Dayton | 1F496 |
| 3 Split Taper 314" | Browning | 2L269 |
| 3 ⅜" Pitch Synchronous Drive | Browning | 18LG075 |
| 1 Synchronous Drive Belt 160 teeth/26" | Browning | 600L075 |
| Electrical Components | | |
| 2 Vari-Drive Variable Speed Motor Control | KB | |
| 1 Enclosed Snap Action Switch - Roller Arm | Omron | ZE-NA2-2S |
| 1 Emergency Stop Switch | Telemecanique | XALJ174 |
| 1 Time Delay Relay | Omron | H3YN2AC1 20 |
| 1 Relay Socket | Omron | PY08A-E |
| 2 Solenoid Valve Coil | Dayton | 6X543 |
| 2 Plug-in Horsepower Resistor | Lawson Prod | PN 9380 |
| 2 Coil Spring Switch | Lawson Prod. | PN 89353 |
| 1 Terminal Block | Lawson Prod. | PN 95542 |
| 1 Conduit Outlet Box | Appleton | FS15O |
| 1 Outlet Box Cover | Appleton | FSK1BC |
| 25 Liquid-Tight Flex Conduit | Liquatite | NM11 |
| 4 90 Degree Connector | Hubbell | NHC-1023-2P |
| 2 Straight Connector | Thomas & Betts | 5232 |
| 6 90 Degree Angle Connector | Thomas & Betts | 5352 |
| 2 Strain Relief Cord Connector | Hubbell | UFCO0O1 |
| 1 NEMA Type 1 Enclosure 14 gauge | Wiegmann | 3A905 |
| 1 Interior Panel for NEMA Type 1 Enclosure | Wiegmann | 2W823 |
| Air & Water Components | | |
| 2 Solenoid Valves | Dayton | 3A434 |
| 6 ¼" Segment Pack 5 ¾" Long | Loc-Line | 41401 |
| 1 ¼" Round Nozzle | Loc-Line | 41404 |
| 2 2 ½" Swivel Nozzle 75 | Loc-Line | 41488 |
| 1 ¼" Male NPT Valve | Loc-Line | 21192 |
| 2 ¼" Y Fitting | Loc-Line | 41408 |
| 46 ½" 90 Degree Copper EII | Nibco | 607 |
| 47 ½" Rigid Copper Pipe | B & K | Type L |
| 48 ½" Slip to ½" Female | Nibco | 03-2 |
| 49 ½" Slip to ½" Male | Nibco | 611 |
| 50 ½" Tee | Nibco | 611 |
| 51 ½" Quick Disconnect - Air | Dyna Quip | D580 |
| 52 Brass Mini Ball Valves | Dyna Quip | VNH3. PM 1/4 |
| 53 2" Nipple Threaded Aluminum | Valley Rubber | HAA-8 |
| 2 ½" to ½" Union | Nibco | |
| 6 Adjustable Air Jets | Exair | 6019 |
| 2 High Flow Air jets | Exair | 6010 |
| 4 Adjustable Air Nozzles (aluminum) | Exair | 1009 |
| 1 ¼" Pneumatic Air Hose | Parker | 63PL-4 |
| 2 ½" Female Coupler x NPT Part B | Harrington | BPP-005 |
| 2 ½" Male Coupler | Harrington | FPP-005 |
| 1 ½" Male x Female Brass Ball Valve | Dyna Quip | VMH2.P9 |
| 4 ½" Bulkhead Fittings | US Plastics | 7801 |
| Conveyor Components | | |
| 1 10' Tabletop Conveyor | Bunting | SLPC 060-11 |
| 2 Steel Floor Supports 35" | n/a | |
| 1 90 VDC Motor 1–30 fpm 35:1 ratio ⅛ hp | Lesson | 985615D |
| 1 Endless Belt 3 ⅝" w | Bunting | |

-continued

| Item & Quantity | Mfg | Model |
|---|---|---|
| ½" high thin-line cleats on 24" centers | | |
| 2 LH & RH bearing retainer block w/phenolic laminated construction | Bunting | |
| Brush Components | | |
| 2 Spiral Coil Nylon 66 Brush ¾" × 16" shaft w/5/16" Bore Key 14" Core Length, Stainless Steel Core 7" Outside Brush Diameter | AIB | 012C8N 6.6 |
| Filtration Components | | |
| In-Tank Filter System Series A-B | | |
| 1 Pump P-1/5A Penguin | A1OO-B | |
| 1 Hytrex II 20 mic Cartridge Filter | Osmonics | GX-20-10 |
| Polyethylene HHPE Molded Tank 24" L × 12" W × 12" D 15 gallon | Harrington | 14150-0020 |
| 1 Float Switch | Square D | 9037HG34 |
| Structural Components | | |
| 20 UHMW "L" Shape Angle 3" × 3" × ½" | US Plastics | 46290 |
| 1 UHMW 3/16" High Density Polyethylene | US Plastics | 46013 |
| 1 UHMW ½" High Density Polyethylene | US Plastics | 46016 |
| 1 Round Slotted-head style - Nylon Screws | US Plastics | 91467 |
| 80 3/16" Stainless Steel Rod | JKEM Metals | n/a |
| 7 PVC Strips 12"W × 7' H | Global | GKSO4OB3 |
| 1 12" × 72" × 14" Upper Cabinet w/split lid 3/16" Aluminum Powder Coated Stainless Steel Base Unit w/legs 14" × 19" × 6" Aluminum Cowling Cover | JKEM Metals | |

PROCESS DESCRIPTION

In the operation of the invention device, the following sequence is observed; Unclean aluminum laps are loaded upon the carrying tray of the invention. Each such tray carries 8 individual laps. The trays are made of UHMW polyethylene plastic and measure ½" D×12"W×18"L. The trays and laps are placed upon a 4" wide Bunting table top style conveyor which carries them into the washing system (through a slatted plastic apron curtain). The system is comprised of two separate chambers enclosed within a single rectangular box measuring 16" D×14" W×72" L which is supported by four adjustable legs measuring approximately 32" H.

The washing process takes place in the first chamber which is equipped with multiple water jets and a pair of rotating brushes. The brushes are made from nylon 66 material and measure 7" in diameter and 10" wide. The brushes rotate away from the incoming lap at a variable rate, normal rotation being at 125 rpm. A variable speed ¼ horsepower Lesson DC motor/gearbox drives the brushes via a synchronous tensioned drive belt and pulley system. The brushes are flooded with recirculated water, filtered through a Harrington Series A-B filtration system using a 20 micron cartridge to remove polish sediment, while the lap is sprayed through two Loc-Line fan spray plastic nozzles. Moistening the brushes facilitates the removal of the unwanted aluminum oxide polish. The brush completely encompasses the convex side of the lap whereas the bottom side of the lap is not brushed. To remove the unwanted polish from the bottom of the lap, it is instead subjected to a forceful steady stream of water provided by two Loc-Line round plastic nozzles.

Once the tray passes from the washing to the drying chamber (through a further slatted plastic apron curtain), it is immediately exposed to a thrust of shop air provided by five Exair® Air Jet units each of which delivers 12.5 oz. of force at a rate of 13.1 SCFM. There are three air units located at the top of the chamber and two below. One top unit is used exclusively to keep the top of the conveyor belt and rack dry. The other two units dry the tops of the laps only. An Omron® snap action switch engages the lap drying portion of the air system which is regulated in its deployment via an Omron® time delay relay. There is a ten second delay between the time the tray is loaded into the washing unit and the activation of the air system.

Before the tray exits the unit, it passes over four Exair® adjustable air nozzles which are located beneath the tray to blow excessive water from the washing chamber off of the lap. Each of these air units delivers 12.5 oz. of force at a rate of 13 SCFM. The latter are wired to the same delay system as the other air jets. Optionally a time delay relay may be installed to offset the amount of air used. The above described process takes approximately 28 seconds.

DETAILED DESCRIPTION OF A PREFERRED EMBODIMENT

Figure 1:
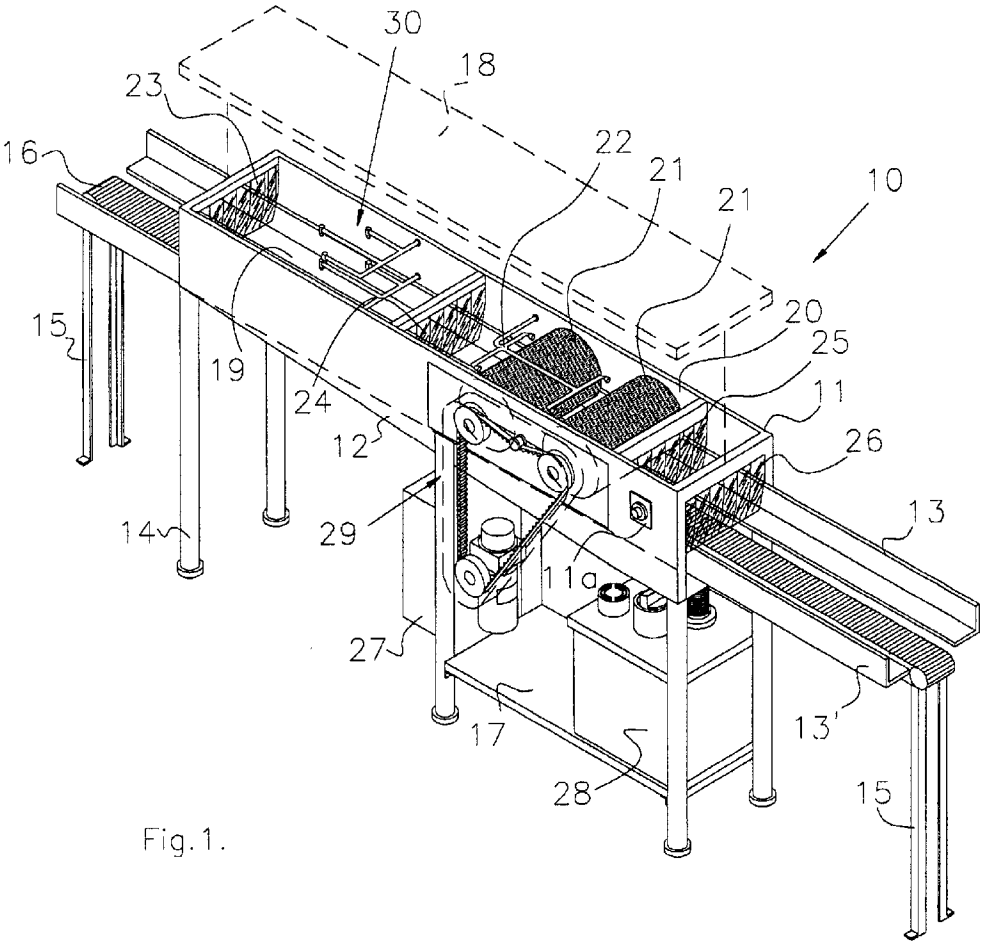
FIG. 1 is an isometric view of the invention shown partially in broken section.
Figure 2:
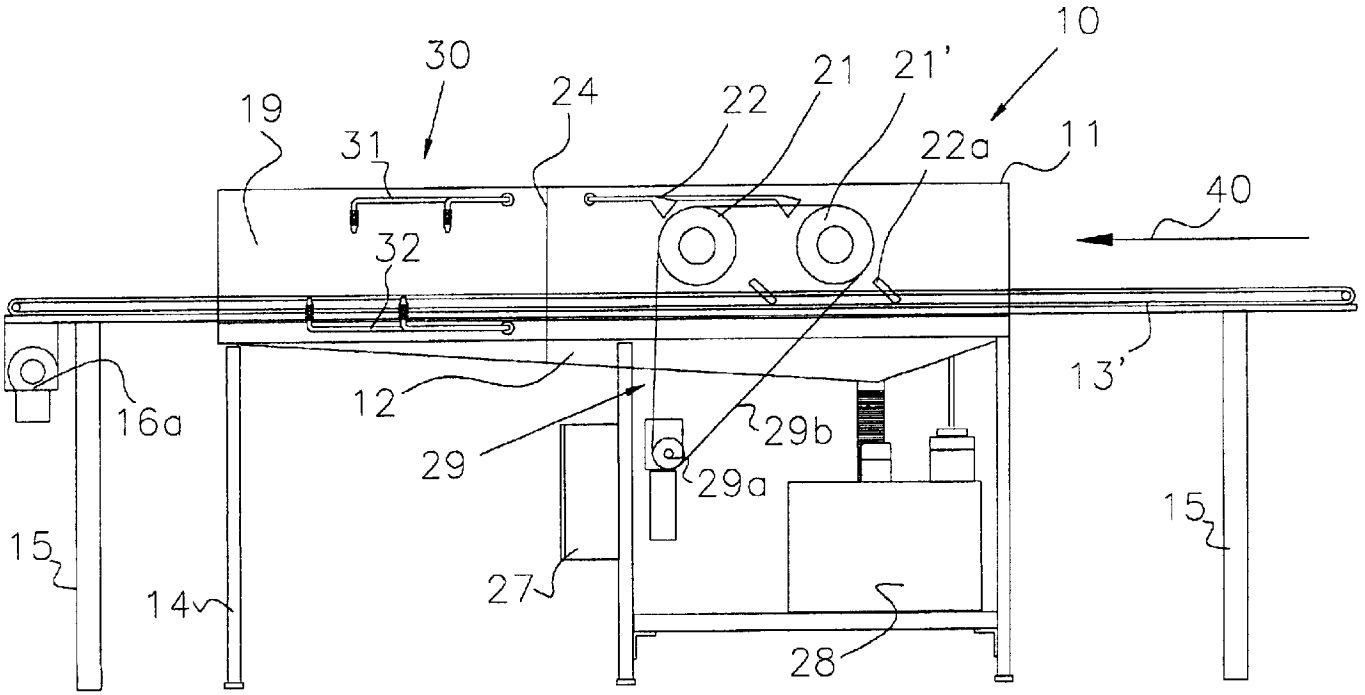
FIG. 2 is a left elevational view of the invention.
Figure 4:
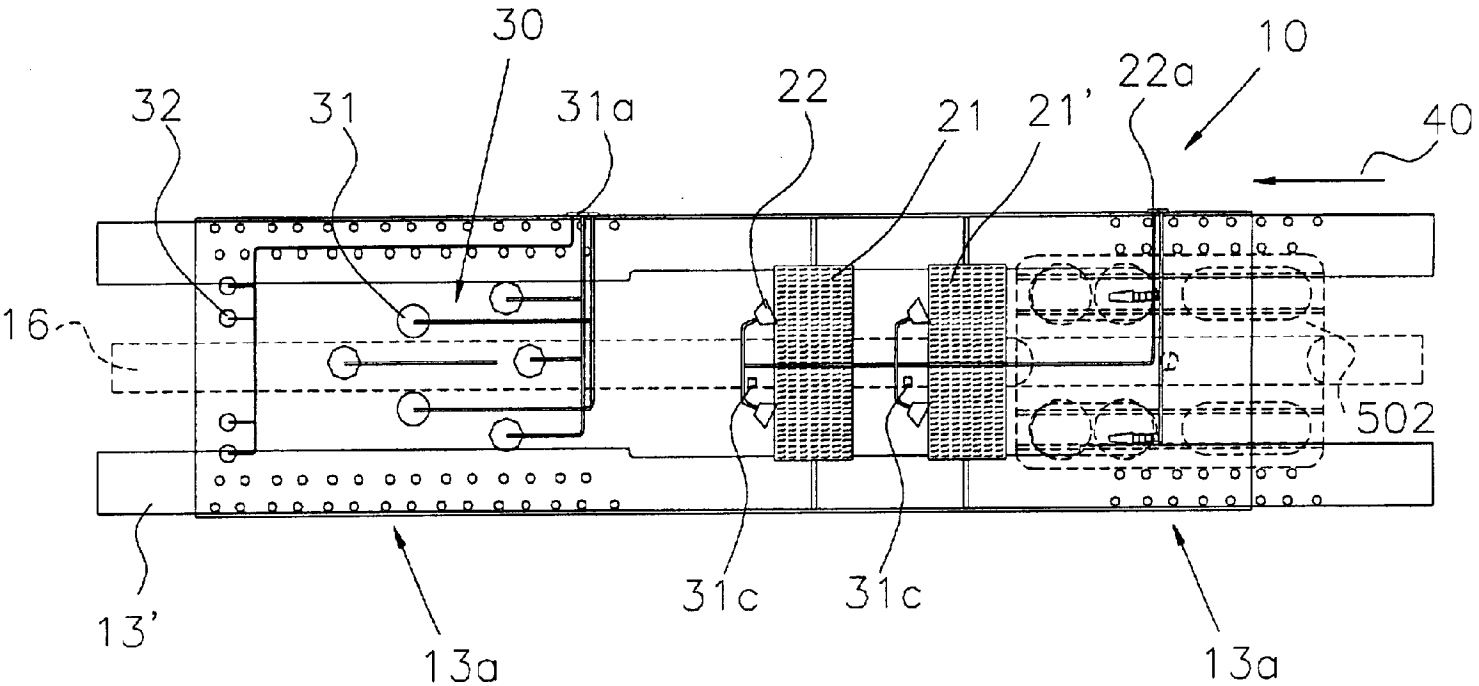
FIG. 4 is a plan view partially in section showing the invention.

Referring now to the drawings wherein like numerals designate like and corresponding parts throughout the several views (except for FIG. 6 wherein the numerals correspond to electrical connections between each component) in FIGS. 1, 2, and 4, the invention Lap Washer is designated overall by the numeral 10. Referring now to FIG. 1, removable lid 18 is removed for clarity. Cabinet 11 is supported by legs 14. Conveyor 16 is supported by legs 15. "L" channels 13 and 13' define a semi enclosed track which runs parallel to tabletop conveyor 16. In operation, this configuration is for smoothly and securely moving trays 500 (FIG. 5) into cabinet 11 through flexible screen curtain 26 and through the length of the washing/drying cycle. Safety stop 11*a* is located adjacent to cabinet 11.

Figure 5:
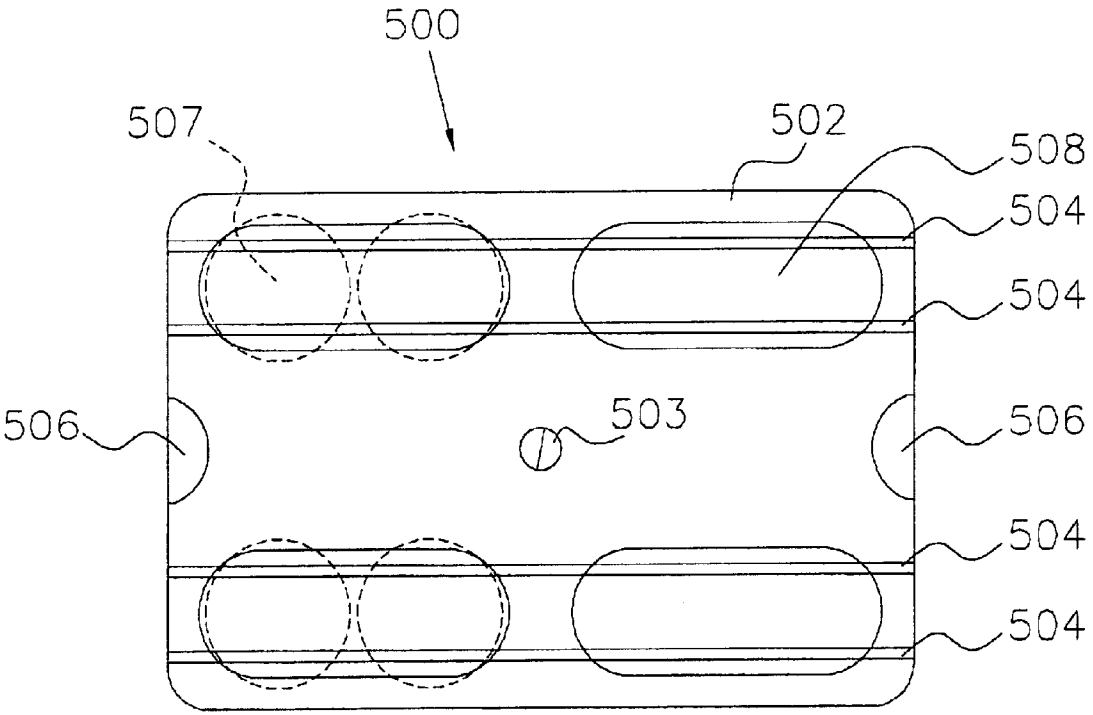
FIG. 5 is a plan view of a carrier tray of the invention.

Water filtration unit 28 is supported by metal shelf 17. Electrical connections and supply are contained within NEMA box 27. National Electrical Manufacturers Association. Water resistant electrical component enclosure approved by NEMA for use in wet environments. Belt drive assembly 29 connects to nylon brushes 21, 21'. Brushes 21, and 21' are housed in washing chamber 20 which is defined by flexible scree curtains 24 and 25. Water jets 22 supply filtered water to the brushes and to the top of trays 500 as they pass through. Lower water jets 22*a* force water upwards below trays 500. The water strikes the bottom of laps 507 by passing through apertures 508 (FIG. 5). The tops of laps 507 are completely encompassed by nylon brushes 21, 21', and kept in place thereby. Unclean water is recovered from cabinet 11 by draining into tray 12 through holes 13*a* (FIG. 4) and thence into filter unit 28.

Reference is now made to FIG. 2 in which trays traveling in the direction of arrow 40, being carried on conveyor 16, driven by motor 16*a*, and passing into drying chamber 30, are blasted by air jets 31 and 32 (FIG. 2). Variable speed motor driving belt 29*b* turns brushes 21 and 21'. Brushes 21 and 21' are spaced 12" apart.

Figure 3A:
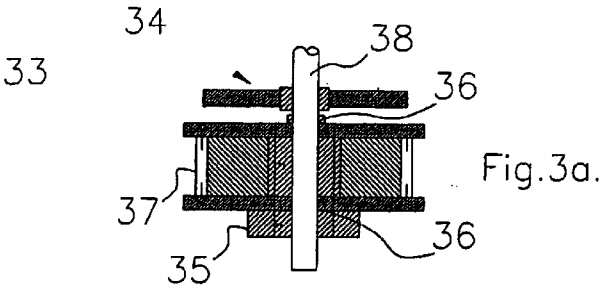
FIGS. 3 and 3*a* are plan and elevational views respectively showing components of the belt/pulley drive system.
Figure 3:
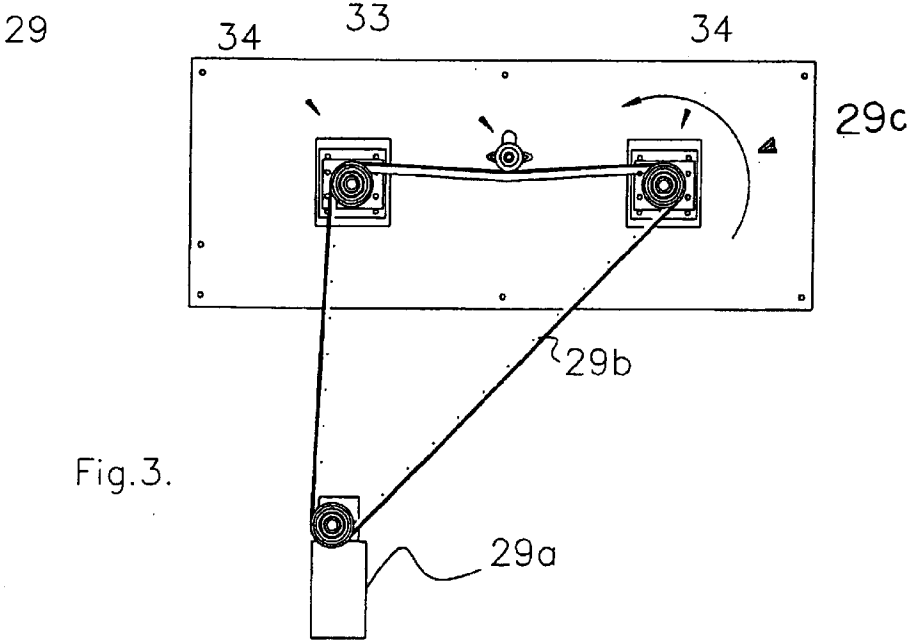

In FIGS. 3 and 3*a*, drive belt assembly 29 comprises, UHMW-PE Bearing assemblies 34 and Drive tightener 33, variable-speed motor assembly 29*a* and belt 29*b* all of which turn brushes 21, 21' in the direction of arrow 29*c* (in a counterclockwise direction). More particularly, in FIG. 3*a*, shaft 38 is supported through UHMW-PE Bearing assembly 34 and attached to ⅜" synchronous drive pulley 37, by split tape 35 Delrin shaft collar 36. Referring again to FIG. 4, water jets 22, direct water against the rotation of brushes 21, 21' which are turning in the direction of arrow 29*c* (FIG. 4).

In FIG. 5, 3/16 stainless steel rods 504, are recessed flush to the top of tray 502 and secured by a polyethylene welding rod. Handle 506 is cut out and nylon screw 503 is located centrally in tray 502.

Figure 6:
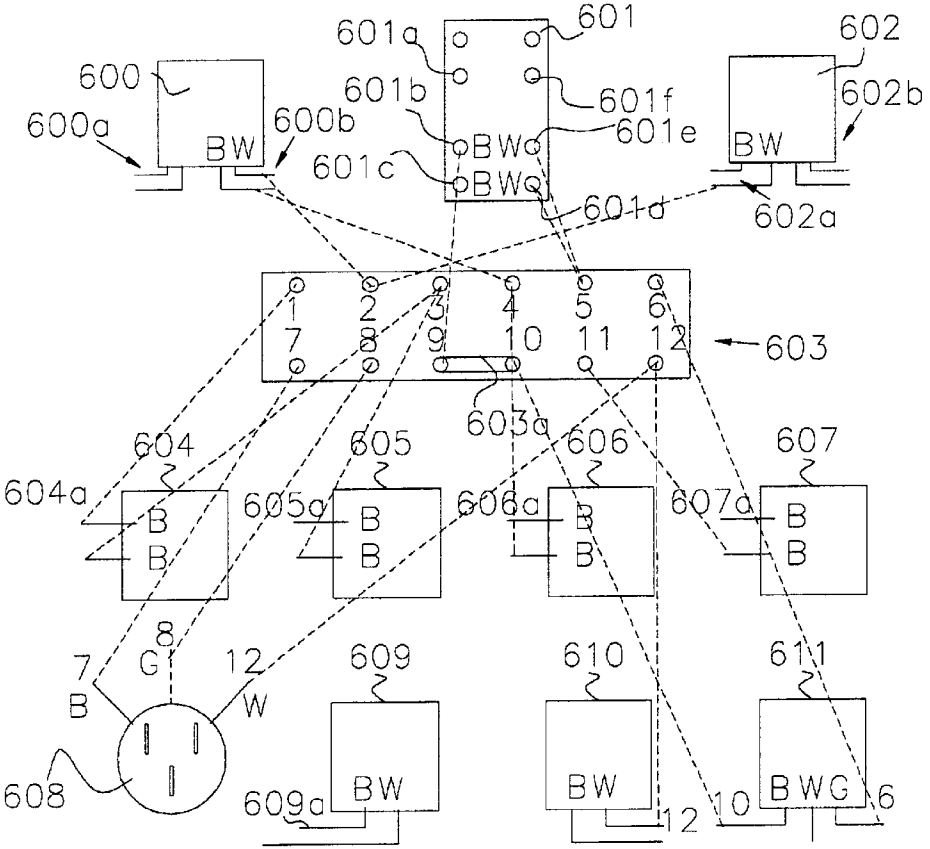
FIG. 6 is a diagrammatic overview of the electrical components and their connective relationships.

Referring now to FIG. 6 electrical diagram, incoming power plug 608, connects its black (7) Green (8) and White (12) terminals to terminal block 603 and thence, via Emergency on/off switch 604 (604*a*) to Brush Control box 600 connectors 600*b* and out to brush motor connections 600*a* to timer relay 601 out to dryer solenoid valve 601*a* and 601*f* through switches 601*b*, 601*c*, and 601*d* and 601*e*, to conveyor control box 602 through switch 602*a* to conveyor motor 602*b*, to air dryer 605 and air solenoid valve 605*a*, to conveyor belt safety stop 606 and its control box 606*a*, to conveyor air jet 607 and air jet solenoid 607*a*, to air solenoid valve for air dryer 609 and timer relay 609*a*, to conveyor air jet solenoid valve 610 and filter pump outlet 611.

Figure 7B:
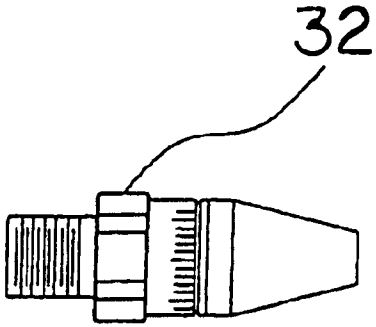
FIGS. 7, 7*a*, and 7*b* are elevational views of air nozzles used in the invention.
Figure 7A:
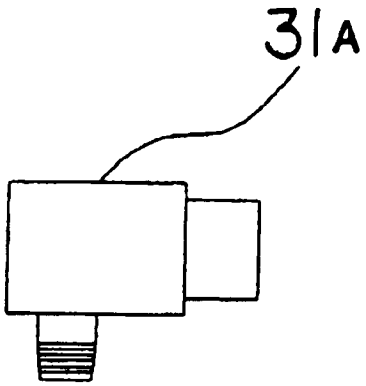
Figure 7:
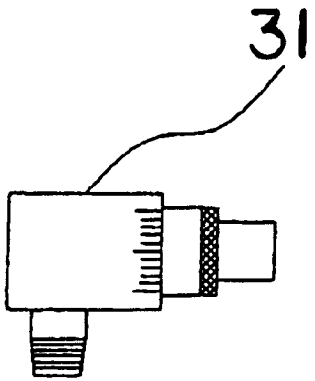

Referring now to FIG. 7 showing an adjustable air jet model 6019 (Exair) having a force of 12.9 oz, a flow rate of 13.1 SCFM (Standard Cubic feet Per Minute) and an estimated % of usage in the drying process of 60% requiring a total of 47.16 SCFM.

Referring now to FIG. 7*a* showing a high flow air jet 31*a*, (FIG. 4) model 6010 (Exair) having a force of 6.5 oz, a flow rate of 6.5 SCFM and an estimated % of usage in the drying process of 25% requiring a total of 3.26 SCFM.

Referring now to FIG. 7*b* showing an adjustable air nozzle 32 (FIG. 4) model 1009 (Exair) having a force of 12.5 oz, a flow rate of 13 SCFM and an estimated % of usage in the drying process of (100%)15% requiring a total of 52 SCFM.

What is claimed is:

1. An automated lap washer and rack system for washing and drying of aluminum laps used in the processing of ophthalmic lenses, said system comprising:

a rectangular cabinet, said cabinet having a first and a second end, a cover removably attached to said cabinet, a first and a second "L" shaped channel, said channels extending through said cabinet, parallel to the longitudinal axis of said cabinet, a tabletop conveyor, said conveyor running through and parallel to the longitudinal axes of said cabinet, said channels thereby forming a conveyance means through said cabinet, a plurality of support legs supporting said cabinet, a plurality of flexible screen curtains attached within said cabinet, said curtains defining a first, a second, and a third chamber, said second chamber having a water delivery means for supplying filtered water and a water recovery means for recovery of unclean water, said water recovery means having an angled pan generally forming the bottom of said second chamber, a plurality of drain holes, a plurality of cylindrical brushes, said brushes being rotatably mounted within said second chamber perpendicular to the longitudinal axis of said cabinet and said conveyor, a driving means for turning said brushes being connected to said brushes, an electrical control means, said control means being connected to said driving means for adjusting speed of said brushes, a water filtration means for filtering said water, said filtration means being connected to said angled pan, a pumping means for circulating said water, said pumping means being connected to said water delivery means, a plurality of air delivery units mounted within said third chamber, said delivery units being connected to an air source, said delivery units having electrical switching means, said switching means for adjusting said air delivery, and a tray, said tray having a plurality of slotted holes, said tray having attachment means, whereby a plurality of said trays being loaded on said conveyance means, said holes in said trays providing access to said water delivery means.

2. An automated lap washer and rack system of claim 1 wherein said flexible screen curtains consist of a plurality of flexible, vertically suspended plastic strips, said water delivery means consist of a plurality of water jets, and said brushes consist of nylon.

* * * * *